US008450037B2

(12) United States Patent
Nauka et al.

(10) Patent No.: US 8,450,037 B2
(45) Date of Patent: May 28, 2013

(54) PHOTOCONDUCTOR FOR ELECTROPHOTOGRAPHY

(75) Inventors: Krzysztof Nauka, Palo Alto, CA (US); Xia Sheng, Palo Alto, CA (US); Hou T. Ng, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/254,892

(22) PCT Filed: Mar. 12, 2009

(86) PCT No.: PCT/US2009/036994

§ 371 (c)(1),
(2), (4) Date: Sep. 6, 2011

(87) PCT Pub. No.: WO2010/104513

PCT Pub. Date: Sep. 16, 2010

(65) Prior Publication Data

US 2012/0003008 A1 Jan. 5, 2012

(51) Int. Cl.
*G03G 15/04* (2006.01)

(52) U.S. Cl.
USPC ..... 430/66; 430/56; 430/58.05

(58) Field of Classification Search
USPC ..... 430/56, 58.05, 66
See application file for complete search history.

(56) References Cited

U.S. PATENT DOCUMENTS

| | | | | |
|---|---|---|---|---|
| 6,180,305 | B1 * | 1/2001 | Ackley et al. | 430/66 |
| 2001/0005568 | A1 | 6/2001 | Sokol et al. | |
| 2003/0186146 | A1 | 10/2003 | Shibata et al. | |
| 2003/0210318 | A1 | 11/2003 | Detig | |
| 2004/0043313 | A1 | 3/2004 | Zhu et al. | |
| 2006/0286471 | A1 | 12/2006 | Mishra et al. | |
| 2007/0015073 | A1 * | 1/2007 | Lin et al. | 430/58.75 |
| 2007/0042281 | A1 * | 2/2007 | Orito et al. | 430/59.5 |
| 2007/0281226 | A1 | 12/2007 | Aziz et al. | |
| 2008/0057426 | A1 * | 3/2008 | McGuire et al. | 430/58.8 |
| 2008/0070138 | A1 | 3/2008 | Yagi et al. | |
| 2008/0166157 | A1 | 7/2008 | Roth et al. | |
| 2009/0004588 | A1 | 1/2009 | Sheng et al. | |
| 2009/0035672 | A1 | 2/2009 | Yanagawa et al. | |

* cited by examiner

*Primary Examiner* — Mark F Huff
*Assistant Examiner* — Stewart Fraser

(57) ABSTRACT

A method for making a photoconductor for electrophotography can comprise depositing a charge generating layer on an electrode; depositing a charge transfer layer on the charge generating layer, where a plurality of charge transfer molecules are disposed within the charge transfer layer; depositing a film of non-conducting material onto the surface of the charge-transfer layer; heating the film and the surface to cause a subset of the charge transfer molecules to move into the non-conducting material, creating in the film a conducting sub-layer and an insulating sub-layer, where the insulating sub-layer is substantially free of charge transfer molecules.

14 Claims, 1 Drawing Sheet

PHOTOCONDUCTOR FOR ELECTROPHOTOGRAPHY

BACKGROUND

Liquid electrophotography (LEP) platforms use electrostatic charge to selectively place charged colorant to create offset images. Liquid electrophotography typically involves uniformly charging a photoconductive surface by depositing electrically charged, energetic atomic and molecular species, and then selectively exposing the surface to light which either imparts or dissipates the electrostatic charge in the exposed areas so that these areas define an image. A liquid toner is then applied to either the charged or uncharged areas to create a toner image which may then be transferred to a print medium to create a printed image.

This printing technique may rely in part on the persistent ability of the photoconductor to present electrostatic charge to its surface. This in turn is based on the availability of charge carrying species in the photoconductor. Therefore, the availability of charge carriers can be a significant factor in the service life of LEP systems. Fabrication and usage approaches that preserve the functionality of LEP photoconductors can enhance the value of these platforms.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

DETAILED DESCRIPTION

Figure 1A:
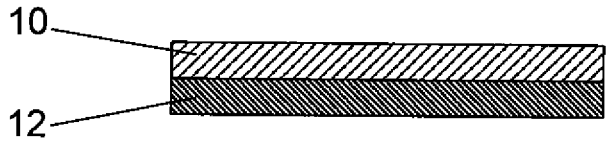
FIGS. 1A through 1D show cross-sectional schematic diagrams of certain layers of a photoconductor prepared in steps in accordance with an embodiment of the present invention.

Before the present invention is disclosed and described, it is to be understood that this disclosure is not limited to the particular process steps and materials disclosed herein because such process steps and materials may vary somewhat. It is also to be understood that the terminology used herein is used for the purpose of describing particular embodiments only. The terms are not intended to be limiting because the scope of the present invention is intended to be limited only by the appended claims and equivalents thereof.

It must be noted that, as used in this specification and the appended claims, the singular forms "a," "an," and "the" include plural referents unless the context clearly dictates otherwise.

The term "liquid electro printing" or "liquid electrophographic printing" (LEP) refers to the printing a liquid toner through an electric field onto a surface to form an electrostatic pattern. The pattern can be transferred to at least one intermediate surface and then to a printing surface or substrate.

As used herein, "liquid electrophotographic ink" or "LEP ink" generally refers to an ink including a liquid vehicle, a colorant, and a charging component. The colorant can be a dye and/or a pigment. The pigment can be a standard pigment colorant or a self-dispersed pigment, such as an encapsulated pigment, a small-molecule modified pigment, or a polymer-attached pigment, as is known in the art. The liquid vehicle can be a fluid in which the colorant of the present disclosure can be dispersed to form an ink. Typical liquid vehicles can include but are not limited to a mixture of a variety of different agents, such as surfactants, co-solvents, buffers, biocides, sequestering agents, compatibility agents, antifoaming agents, oils, emulsifiers, viscosity modifiers, etc. in some embodiments, the LEP ink can include a binder.

The term "substantially" when referring to a structure that is "substantially free of" or "substantially absent" of a specific material indicates that the structure is either completely devoid of that specific material, or there are only residual amounts of that specific material present. For example, when referring to an insulating sub-layer that is substantially free of charge transfer molecules, it is not required that the insulating sub-layer include absolutely no charge transfer molecules. Rather, if any residual concentration of molecules is present, they would have no impact on the insulating properties of the insulating sub-layer, e.g. perhaps a few residual numbers of molecules spaced sufficiently apart so that they do not provide conductive properties. That being stated, in one embodiment the charge transfer molecules can be completely absent in the insulating sub-layer.

As used herein, the modifier "non-conducting" or "non-conductive" refers to materials that have little or no intrinsic capacity to transmit electric or electronic current. Conversely, the modifier "conducting" may be used to refer not only to highly conductive materials (e.g. metals, alloys) but also to more semiconducting materials which may comprise a non-conducting matrix that is sufficiently doped with charge-carrier transferring molecules so as to be capable of passing electronic current. For example, a sub-layer of non-conductive material that includes a sufficient number of molecules capable of transmitting electrons or holes may be considered a conducting sub-layer.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and sub-ranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

It is noted that when discussing the present devices or methods, each of these discussions can be considered applicable to each of these embodiments, whether or not they are explicitly discussed in the context of that embodiment. Thus, for example, in discussing a film in a device, such a film can also be used in the method and is thus applicable to that embodiment, and vice versa.

With these definitions in mind, a method of making a photoreceptor for electrophotography can comprise depositing a charge generating layer on an electrode, depositing a charge transfer layer onto the charge generating layer, depositing a film comprising a non-conducting material onto the surface, and heating the film and the surface for a time and at a temperature. The charge generating layer can comprise a material that generates charge carriers (e.g. electron-hole pairs) upon exposure to light. The charge transfer layer can have disposed therein a plurality of charge transfer molecules capable of accepting and delivering charge carriers, and the charge transfer layer can have a surface. Further, the heating can cause a subset of the charge transfer molecules to move into the non-conducting material to create within the film a conducting sub-layer adjacent to the charge transfer layer and an insulating sub-layer situated distally with respect to the charge transfer layer. Also, the insulating sub-layer can be substantially free of charge transfer molecules.

In another embodiment, a photoconductor for electrophotography can comprise a charge generating layer disposed on an electrode, a charge transfer layer disposed on the charge generating layer, and a film of non-conducting material disposed on the charge transfer layer and comprising a conducting sub-layer adjacent to the charge transfer layer and an insulating sub-layer situated distally to the charge transfer layer. Additionally, a plurality of charge transfer molecules can be distributed within the charge transfer layer and the conducting sub-layer while being substantially absent from the insulating sub-layer.

In further detail, organic photoconductors (OPCs) used in LEP systems often comprise a flexible substrate supporting a stack of thin layers of material that provide transient electrostatic functionality. These layers may include an electrode, a charge generating layer, and a charge transfer layer. The electrode can be operably connected to an electrical source and thereby provide the underlying electrical potential for operation of photoconductor. The charge generating layer and charge transfer layer are disposed on the electrode and collectively serve to produce and transmit charge between the electrode and the surface in response to light. The charge generating layer, which can be disposed on the electrode itself, serves to generate charge carriers of a polarity (i.e. electrons or holes) in response to exposure to light. The charge transfer layer may be disposed on the charge generating layer and may comprise a matrix of non-conductive material that is doped with charge transfer molecules (CTMs). The charge transfer molecules are molecules that are capable of transferring a charge of a desired polarity across the charge transfer layer so that the overall charge of the OPC surface is modified. This charge movement is used to pattern a toner applied to the surface, and thereby create an image.

Over the course of repeated use, exposure to energetic charged atomic and molecular species providing the surface charging, a well as to the liquid toner can degrade the electrical quality of the photoconductor region adjacent to the surface and render the charge transfer layer less effective. Without being bound to a single particular theory, it has been found that degradation of the electrical quality of the top surface region can result from complex interactions involving constituent materials in the charge transfer layer, (i.e. the non-conductive matrix material and CTMs), as well as the toner chemicals and energetic charged particles delivering charges to the surface. One approach to reducing this effect can be to place a protective film on the OPC surface to prevent interaction between toner chemicals and CTMs. Such a protective film may be a non-conductive material that exhibits minimal reactivity with chemicals typically used in LEP. Due to the non-conductive properties of the film, it can be beneficial to utilize a very thin protective film, e.g. on the order of tens of nanometers in order to preserve the electrical response profile of the surface. However, deposition of a film this thin can present significant technical challenges. In contrast, readily available techniques for applying suitable materials are typically more suited to producing coatings well over a micron thick. This can be particularly true for organic materials, where techniques for laying submicron coatings can be costly and not readily amenable to conventional fabrication processes. Thicker coatings, while possibly protective, can also severely reduce the functionality of the underlying photoconductor layers by greatly increasing the electrical resistance of the OPC surface.

Figure 1B:
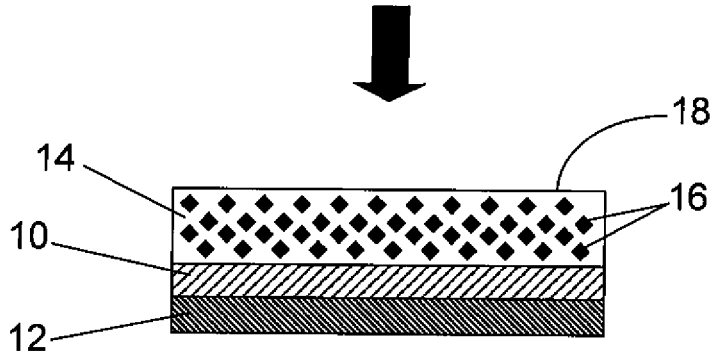

Accordingly, the method and device disclosed herein can provide an improvement of these older systems, making a photoconductor that provides protection to the charge transfer layer while largely preserving its electrical properties. As illustrated in FIGS. 1A through 1D, a general embodiment of the method can comprise assembling the constituent layers of the photoconductor. More specifically, as shown in FIGS. 1A and 1B, this method can more comprise depositing a charge generating layer 10 on an electrode 12 and then depositing a charge transfer layer 14 on the charge generating layer, wherein a plurality of charge transfer molecules (CTMs) 16 are distributed within the charge transfer layer. While the CTMs may be distributed throughout the depth of the layer, they may be also disposed adjacent to the surface 18 of the layer. Fabrication and deposition of these layers may be accomplished through conventional techniques used in the art.

Figure 1C:
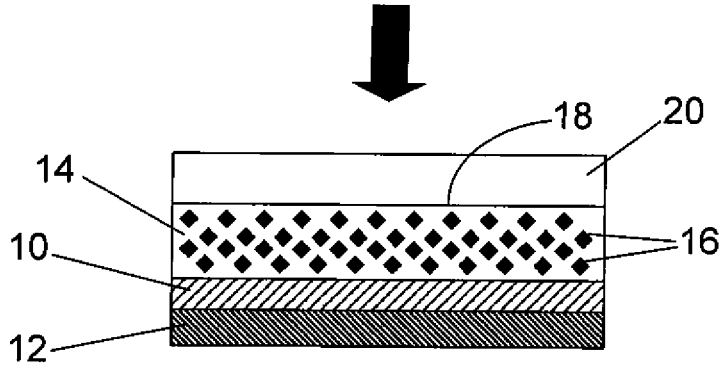

Turning to FIG. 1C, the method also comprises depositing a film 20 of non-conducting material onto the surface 18 of the charge transfer layer 14. The non-conducting material can comprise a material that is suitable for protection of the underlying layer under sustained operating conditions, that is, the material may be one that is both non-conducting and relatively inert with respect to chemicals used in LEP printing. In a particular embodiment, the material may be of a same type as the matrix material of the charge transfer layer, or at least share a number of properties with that material. In a more particular embodiment, the non-conducting material may be the same material as used in the charge transfer layer. For example, the non-conducting material used for the film may be the non-conducting matrix material of the charge transfer layer. Therefore, the non-conducting material can include a polymer known to be suitable for fabricating charge transfer layers, such as polycarbonates. Other non-limiting examples of suitable material for the film include poly(ether sulfone), poly(phenylene oxide), polystyrenes, poly(methyl methacrylate), and poly(ethylene napthalate). Alternatively, this material may comprise non-polymeric insulating organic species or non-conductive non-organic species.

The physical arrangement of the material in the film may also be selected so as to allow for a desired mobility of CTMs. For example, in a crystalline material diffusion of CTMs may be affected by lattice structure or may largely be limited to grain boundaries in the case of polycrystalline material. Such structural organization issues may therefore be taken into account in choosing a film material, depending on the rate and manner of diffusion desired. Alternatively, an amorphous material may be selected so as to impact diffusion to a lesser degree. Accordingly, in a particular embodiment, the non-conducting material may be an amorphous material.

Figure 1D:
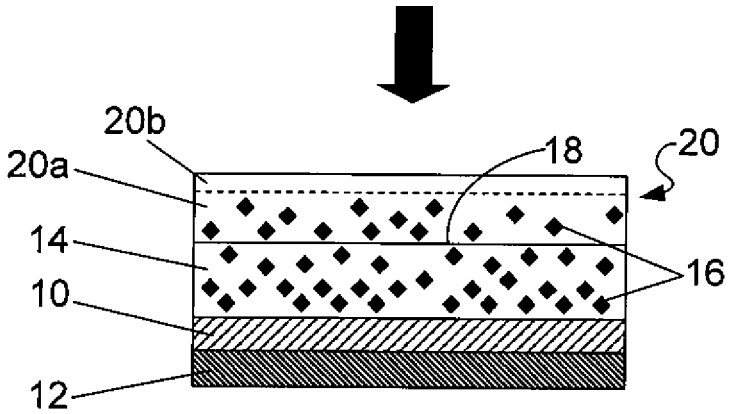

As shown in FIG. 1D, the method may then comprise heating the film and/or the underlying layer(s) until they reach a temperature at which some of the CTMs move from the charge transfer layer into the non-conducting material. More specifically, the elevated temperature can allow diffusion of a subset of CTMs outward for some distance into the overlying film. Generally only a subset of the total number of CTMs in the charge transfer layer will diffuse into the overlying film. More specifically, most of the CTMs that diffuse out of the charge transfer layer may be those situated adjacent to the surface of that layer. The number of CTMs that diffuse may constitute a small fraction of the total number of CTMs in the charge transfer layer when deposited. Therefore, the diffusion of CTMs into the non-conducting material can have a significant effect on the electrical properties of that material, while having a negligible effect on the properties of the charge transfer layer.

In a particular embodiment, a heating time and temperature is utilized that produce sufficient heating in the film and the underlying layer so that CTMs freely move within the materials, while not reaching a degree of heating that would degrade the film material or CTMs. In an example, the temperature utilized is from about 80° C. to about 110° C. As such, one aspect of the non-conducting material chosen may be that it can withstand a temperature at which the CTMs diffuse well without itself losing significant integrity. In one aspect, a non-conducting material may be chosen that has a relatively high glass transition temperature or decomposition temperature.

In another aspect, CTMs may be chosen that exhibit a high rate of diffusion at relatively low temperatures. Some non-limiting examples of suitable CTMs for use in photoconductors include hole transporters such as arylalkanes, arylamines, hydrazones, poly(phenylenevinylene)s, polysilylenes, poly(N-vinylcarbazole)s and its derivatives, and pyrazolines, as well as electron dopants such as diphenoquinones, and complexes of poly(N-vinylcarbazole) and 2,4,7-trinitro-9-fluorene. However, it will be understood that a suitable CTM according to the present embodiment can depend at least partly on the non-conducting film material into which it is to diffuse.

Therefore, in accordance with the present method a suitable combination of non-conducting material and CTMs may be selected based on known properties of each. Likewise, the time and temperature may be selected based on these characteristics so as to achieve a desired concentration profile of CTMs within the film. In a particular aspect, the resulting profile includes CTMs that are distributed within the film but have stopped diffusing short of the surface of the film. In such a profile, two zones or sub-layers effectively exist within the film: a conducting sub-layer 20*a* adjacent to the charge transfer layer and containing the diffused CTMs and therefore capable of conducting charge to or from underlying layers of the OPC; and a thin sub-layer at the surface of the film that is substantially free of CTMs and therefore largely insulating. In FIG. 1D, the boundary between these sub-layers are represented by a dotted line, with the conducting sub-layer 20*a* shown below the dotted line and the insulating sub-layer 20*b* is shown above the dotted line. It should be noted that this representation is provided mainly to illustrate the existence of the two regions, rather than to characterize the shape of the regions or any boundary between them. As these sub-layers arise from molecular motion, it will be appreciated that the sub-layers may exhibit a degree of irregularity in form.

With further reference to the CTM profile within the film, and in view of the discussion above, it has been found that diffusing CTMs well into the protective film while maintaining a substantially CTM-free zone at the surface can provide certain useful qualities. One aspect of such an arrangement is that by maintaining some distance between the furthest diffused CTMs and the film surface (now the working surface of the OPC), deleterious interaction of the photoconductor materials with toner or other printing chemicals may be reduced or eliminated. This can significantly enhance the useful life of the OPC. Another aspect is that by making the distance between the furthest diffused CTMs and the film surface quite small, the protection referred to above may be achieved without greatly changing the ability of the surface to be charged or discharged. It may be appreciated therefore, that the present method may involve selecting some balance point between these two aspects. As such, a particular embodiment can involve heating the film and underlying layer(s) so that CTMs diffuse as far into the protective film as possible while still leaving enough depth of CTM-free at the surface so as to effectively protect the CTMs in the film from degrading forces.

In accordance with the above, a more particular embodiment of the method can comprise heating the film and underlying layer(s) at a time and a temperature so as to cause the CTMs to diffuse to a specific extent. In a particular aspect of this, the heating parameters may be chosen so that the insulating sub-layer that remains after diffusion has a particular thickness. In a more specific embodiment, the resulting insulating sub-layer has a thickness of less than about 50 nm. In a still more specific embodiment, the insulating sub-layer has a thickness of less than about 10 nm.

In another aspect, the heating parameters may also be chosen to shape the concentration profile of the charge transfer molecules in the conducting sub-layer. For example, diffusion of the CTMs at a particular rate and for a particular time may produce a concentration gradient in the sub-layer. In one embodiment, the concentration gradient may be such that CTM concentration is highest adjacent to the charge transfer layer and gradually decreases outward toward the film surface. Furthermore, the non-conducting material, the CTM, heating parameters, or any combination of these may be selected so as to impart a particular rate of change in CTM concentration along the gradient. For example, the resulting gradient may exhibit a linear rate of change in concentration, and the rate may be rapid or quite gradual. Alternatively, the resulting gradient may exhibit a non-linear (e.g. logarithmic) rate of change in concentration. These exemplary concentration profiles and others may be available based on the knowledge in the art concerning the diffusion kinetics of the charge transfer molecules and the material properties.

The present method provides a way to make a photoconductor with a protective layer that is thin enough to preserve the charging properties of the photoconductor. While a microns-thick layer may readily be deposited by straightforward techniques, deposition of a sufficiently thin (e.g. tens of nanometers) layer presents a significantly greater technical challenge. However, the present approach for creating a thin insulating layer allows one to deposit a relatively thick layer of material. Accordingly, in a particular embodiment, the film of non-conducting material may be deposited at a thickness of from about 0.5 μm to about 5 μm.

Summarizing and reiterating to some extent, a photoconductor for electrophotography and method of making a photoconductor for electrophotography has been developed which provides a protective film over charge transfer molecules. The film can include a thin sub-layer that is substantially free of charge transfer molecules. In particular, the method allows the generation of a thin protective layer from the deposition of a relatively thick layer of non-conducting material. This may prove particularly useful in increasing the service life of LEP photoconductors.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A method of making a photoconductor for electrophotography, comprising:

depositing a charge generating layer on an electrode;

depositing a charge transfer layer on the charge generating layer, said charge transfer layer having a plurality of charge transfer molecules disposed therein, and said charge transfer layer having a surface;

depositing a film of a non-conducting material onto the surface; and heating the film and the surface for a time and at a temperature, wherein the heating causes a subset of the charge transfer molecules to move into the non-conducting material to create within the film a conducting sub-layer adjacent to the charge transfer layer and an insulating sub-layer situated distally with respect to the charge transfer layer, and wherein the insulating sub-layer is substantially free of charge transfer molecules and has a thickness of less than about 50 nm.

2. The method of claim 1, wherein the heating results in a concentration gradient of the charge transfer molecules within the conducting sub-layer.

3. The method of claim 1, wherein the film is deposited at a thickness of from about 0.5 μm to about 5 μm.

4. The method of claim 1, wherein the non-conducting material is also present in the charge transfer layer.

5. The method of claim 1, wherein the heating comprises a plurality of heating steps, wherein the temperature and time are changed in at least one heating step.

6. The method of one of claim 1, wherein the non-conducting material comprises polymer selected from poly(ether sulfone), poly(phenylene oxide), polystyrenes, polycarbonates, poly(methyl methacrylate), poly(ethylene napthalate), and combinations thereof.

7. The method of claim 1, wherein the charge transfer molecules are selected from the group consisting of arylalkanes, arylamines, hydrazones, poly(phenylenevinylene)s, polysilylenes, poly(N-vinylcarbazole)s, pyrazolines, diphenoquinones, derivatives, combinations, and complexes thereof.

8. The method of claim 1, wherein the temperature is from about 80° C. to about 110° C.

9. A photoconductor for electrophotography, comprising:

a charge generating layer disposed on an electrode;

a charge transfer layer disposed on the charge generating layer;

a film of non-conducting material disposed on the charge transfer layer and comprising a conducting sub-layer adjacent to the charge transfer layer and an insulating sub-layer situated distally to the charge transfer layer, the insulating sub-layer having a thickness of less than about 50 nm; and a plurality of charge transfer molecules distributed within the charge transfer layer and the conducting sub-layer while being substantially absent from the insulating sub-layer.

10. The photoconductor of claim 9, wherein a concentration gradient of the charge transfer molecules exists within the conducting sub-layer.

11. The photoconductor of claim 9, wherein the non-conducting material is also present in the charge transfer layer.

12. The photoconductor of claim 9, wherein the non-conducting material comprises a polymer selected from poly (ether sulfone), poly(phenylene oxide), polystyrenes, polycarbonates, poly(methyl methacrylate), poly(ethylene napthalate) and combinations thereof.

13. The photoconductor of claim 9, wherein the charge transfer molecules are selected from the group consisting of arylalkanes, arylamines, hydrazones, poly(phenylenevinylene)s, polysilylenes, poly(N-vinylcarbazole)s, pyrazolines, diphenoquinones, derivatives, combinations, and complexes thereof.

14. The photoconductor of claim 9, wherein the film is deposited at a thickness of from about 0.5 μm to about 5 μm.

* * * * *